US011644770B2

(12) United States Patent
Tanaka et al.

(10) Patent No.: US 11,644,770 B2
(45) Date of Patent: May 9, 2023

(54) INTERMEDIATE TRANSFER BODY AND IMAGE FORMING APPARATUS

(71) Applicant: FUJIFILM Business Innovation Corp., Tokyo (JP)

(72) Inventors: Hiroaki Tanaka, Kanagawa (JP); Shigeru Fukuda, Kanagawa (JP); Kenta Yamakoshi, Kanagawa (JP); Yosuke Kubo, Kanagawa (JP); Masayuki Seko, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/467,594

(22) Filed: Sep. 7, 2021

(65) Prior Publication Data

US 2022/0373939 A1 Nov. 24, 2022

(30) Foreign Application Priority Data

May 24, 2021 (JP) ..... JP2021-087064

(51) Int. Cl.
*G03G 15/16* (2006.01)

(52) U.S. Cl.
CPC ..... *G03G 15/162* (2013.01); *G03G 15/161* (2013.01)

(58) Field of Classification Search
CPC ..... G03G 15/161; G03G 15/162
See application file for complete search history.

(56) References Cited

U.S. PATENT DOCUMENTS 8,084,170 B2 * 12/2011 Kami ..... G03G 5/0578 430/66
2017/0242373 A1 * 8/2017 Matsushima ..... G03G 15/162

FOREIGN PATENT DOCUMENTS

JP 2013-231964 A 11/2013
JP 2015-028614 A 2/2015

* cited by examiner

*Primary Examiner* — Clayton E. LaBalle
*Assistant Examiner* — Michael A Harrison
(74) *Attorney, Agent, or Firm* — Sughrue Mion, PLLC

(57) ABSTRACT

An intermediate transfer body includes a base layer and a surface layer disposed on the base layer, in which surface layer includes a sea-island structure that includes a sea phase and an island phase, in which the sea phase includes a resin, the island phase including an organopolysiloxane.

20 Claims, 2 Drawing Sheets

INTERMEDIATE TRANSFER BODY AND IMAGE FORMING APPARATUS

CROSS-REFERENCE TO RELATED APPLICATIONS

This application is based on and claims priority under 35 USC 119 from Japanese Patent Application No. 2021-087064 filed May 24, 2021.

BACKGROUND

(i) Technical Field

The present disclosure provides an intermediate transfer body and an image forming apparatus.

(ii) Related Art

Japanese Laid Open Patent Application Publication No. 2013-231964 discloses an electrophotographic intermediate transfer body that includes a base layer and a surface layer, the surface layer having a matrix-domain structure extending in the thickness direction. The matrix includes a binder resin. The domain includes perfluoropolyether. The microhardness of the electrophotographic intermediate transfer body measured with an ultramicrohardness meter is 50 MPa or more.

Japanese Laid Open Patent Application Publication No. 2015-028614 discloses an electrophotographic intermediate transfer body that includes a base layer and a surface layer, the surface layer including a binder resin and perfluoropolyether. The amount of perfluoropolyether extracted from the intermediate transfer body when the intermediate transfer body is immersed, at 25° C. for 24 hours, in a solvent prepared by mixing 1,1,2,2,3,3,4-heptafluorocyclopentane and methyl ethyl ketone at a mass ratio of 1:1 is 0.10 mg or more and 5.00 mg or less per 10 $mm^3$ of the surface layer.

SUMMARY

Aspects of non-limiting embodiments of the present disclosure relate to an intermediate transfer body that may reduce the formation of colored streaks caused as a result of faulty cleaning of the intermediate transfer body, compared with an intermediate transfer body in which the island phase of the surface layer includes perfluoropolyether instead of an organopolysiloxane.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an intermediate transfer body including a base layer and a surface layer disposed on the base layer, in which the surface layer includes a sea-island structure, the sea-island structure including a sea phase and an island phase, in which the sea phase includes a resin, the island phase including an organopolysiloxane.

BRIEF DESCRIPTION OF THE DRAWINGS

An exemplary embodiment of the present disclosure will be described in detail based on the following figures, wherein.

DETAILED DESCRIPTION

Figure 1:
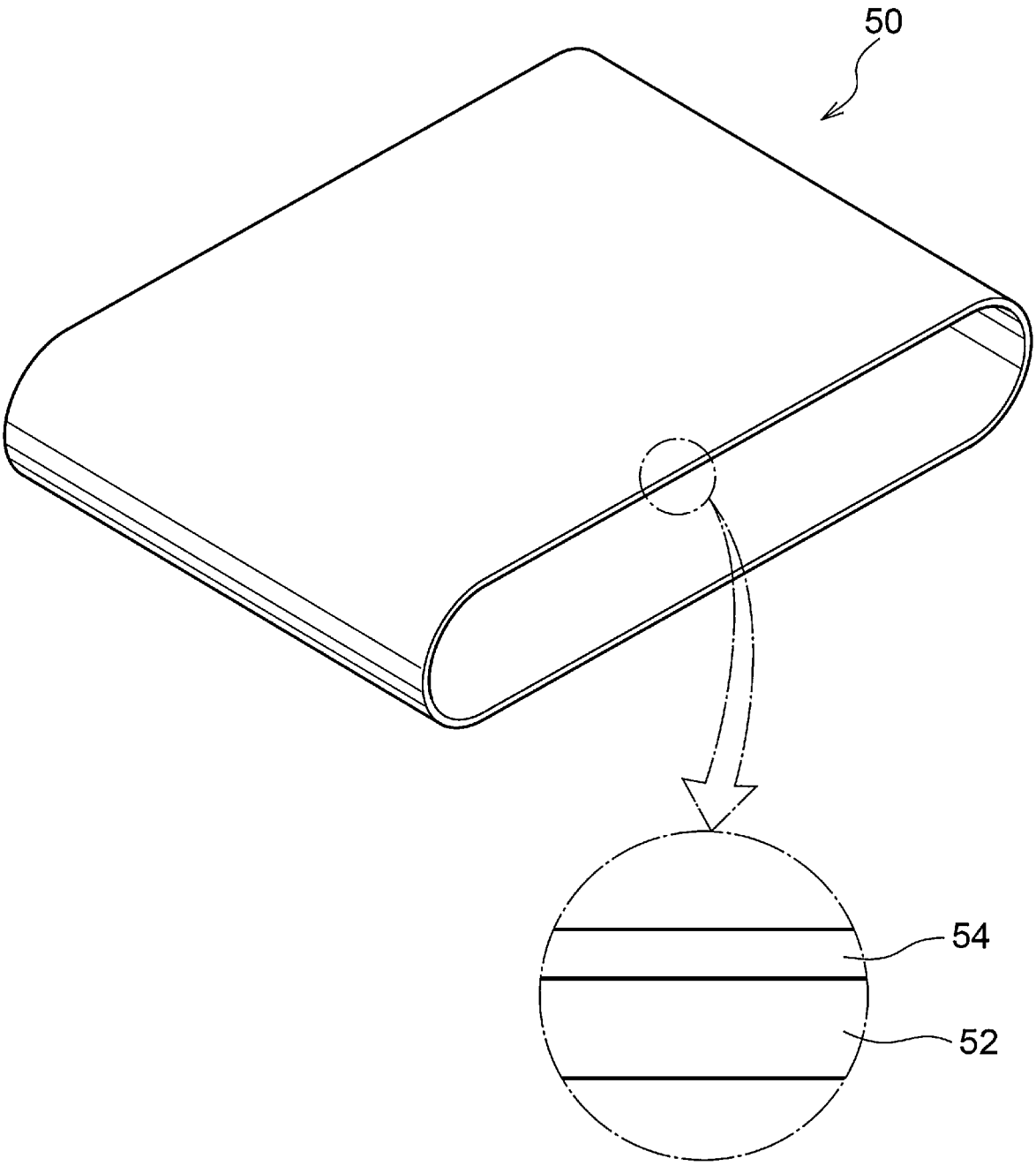
FIG. 1 is a schematic perspective view of an example of an intermediate transfer body according to an exemplary embodiment.

An exemplary embodiment of the present disclosure is described below. The following description and Examples below are intended to be illustrative of the exemplary embodiment and not restrictive of the scope of the exemplary embodiment.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

The term "step" used herein refers not only to an individual step but also to a step that is not distinguishable from other steps but achieves the intended purpose of the step.

In the present disclosure, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the present disclosure may include plural types of substances that correspond to the component. In the present disclosure, in the case where a composition includes plural types of substances that correspond to a component of the composition, the content of the component in the composition is the total content of the substances in the composition unless otherwise specified.

Intermediate Transfer Body

An intermediate transfer body according to this exemplary embodiment includes a base layer and a surface layer disposed on the base layer. The surface layer has a sea-island structure that includes a sea phase including a resin and an island phase including an organopolysiloxane.

The intermediate transfer body according to this exemplary embodiment may reduce the formation of colored streaks caused as a result of faulty cleaning of the intermediate transfer body, compared with an intermediate transfer body in which the island phase of the surface layer includes perfluoropolyether instead of an organopolysiloxane. The mechanisms are presumably as follows.

An intermediate transfer body that includes a surface layer including perfluoropolyether in order to, for example, reduce the adhesion of a toner to the surface of the intermediate transfer body is known. However, the perfluoropolyether may bleed out to the surface. Note that the term "bleed out" used herein refers to seepage or precipitation of a constituent. The perfluoropolyether that has bled out to the surface of the intermediate transfer body may become deposited at a position at which a cleaning blade, which is arranged to contact with the intermediate transfer body and cleans the intermediate transfer body, contacts with the intermediate transfer body. This causes faulty cleaning, such as passing of a toner through the cleaning blade. Consequently, colored streaks may be formed in the resulting image.

In contrast, the intermediate transfer body according to this exemplary embodiment includes a surface layer including an organopolysiloxane instead of perfluoropolyether. Since the surface layer includes an organopolysiloxane, the adhesion of a toner to the intermediate transfer body is reduced. Furthermore, since an organopolysiloxane is not likely to bleed out unlike perfluoropolyether, faulty cleaning, such as passing of a toner through a cleaning blade of the intermediate transfer body, may be reduced. This reduces formation of colored streaks.

FIG. 1 is a schematic perspective view of an example of the intermediate transfer body according to this exemplary embodiment. The intermediate transfer body 50 illustrated in FIG. 1 is an endless belt-like member. The intermediate transfer body according to this exemplary embodiment is not limited to this and may be roller-like.

The intermediate transfer body 50 illustrated in FIG. 1 includes a base layer 52 and a surface layer 54. The surface layer 54 is a layer constituting the outer peripheral surface of the intermediate transfer body 50. The surface layer 54 has a sea-island structure. The sea-island structure of the surface layer 54 includes a sea phase including a resin and an island phase including an organopolysiloxane.

The volume resistivity of the intermediate transfer body 50 may be $1.0\times10^{7}$ Ω·cm or more and $1.0\times10^{12}$ Ω·cm or less.

In this exemplary embodiment, volume resistivity (log Ω·cm) is measured in the following manner.

The measurement is conducted at a temperature of 22° C. and a relative humidity of 55%. The sample is placed in the above measurement environment for 24 hours or more to perform air conditioning. The resistance meter used is a micro current meter "R8430A" produced by Advantest Corporation. The probe used is a UR probe produced by Mitsubishi Chemical Corporation. In the measurement, a voltage of 1 kV is applied to the intermediate transfer body for 5 seconds. A weight of 2 kg is placed on the UR probe. The measurement is conducted at the center and both ends (i.e., 3 positions) of the intermediate transfer body in the width direction, for each of 6 positions spaced at regular intervals in the circumferential direction of the intermediate transfer body, that is, 18 positions in total. The arithmetic average of resistance values measured at the above 18 positions is calculated.

Details of each of the layers constituting the intermediate transfer body are described below.

Base Layer

The base layer may be a semiconductive film or sheet including a resin and a conductant agent.

Examples of the resin include a polyamide, a polyimide, a polyamide imide, a polyether imide, a polyether ether ketone, a polyphenylene sulfide, a polyethersulfone, a polyphenylsulfone, a polysulfone, a polyethylene terephthalate, a polybutylene terephthalate, a polyacetal, a polycarbonate, and a polyester. A polyimide, a polyamide imide, and a polyether ether ketone may be used in consideration of the strength and durability of the base layer. The above resins may be used alone or in combination of two or more.

Examples of the conductant agent include carbon black materials, such as Ketjenblack, oil furnace black, channel black, and acetylene black; metals, such as aluminum and nickel; metal oxides, such as indium tin oxide, tin oxide, titanium oxide, and yttrium oxide; ionic conductive substances, such as potassium titanate, potassium chloride, sodium perchlorate, and lithium perchlorate; and ionic conductive polymers, such as polyaniline, polyether, polypyrrole, polysulfone, and polyacetylene. The above conductant agents may be used alone or in combination of two or more.

Carbon black may be used as a conductant agent included in the base layer. The average primary particle size of carbon black used as a conductant agent may be 10 nm or more and 40 nm or less.

The content of the conductant agent varies by the type of the conductant agent used. In the case where carbon black is used as a conductant agent, the content of the conductant agent may be 5 parts by mass or more and 40 parts by mass or less relative to 100 parts by mass of the resin.

The volume resistivity of the base layer may be $1.0\times10^{7}$ Ω·cm or more and $1.0\times10^{12}$ Ω·cm or less.

The base layer may include additives, such as an antioxidant, a crosslinking agent, a flame retardant, a colorant, a surfactant, a dispersant, and a filler.

The thickness of the base layer may be 30 μm or more and 150 μm or less.

Surface Layer

The surface layer includes a resin and an organopolysiloxane in a mixed manner while they are phase-separated from each other. The resin is included in the surface layer in a relatively continuous manner, while the organopolysiloxane is included in the surface layer in a relatively discontinuous manner. The continuous phase that includes the resin is a sea phase, while the disperse phase that includes the organopolysiloxane is an island phase. In this exemplary embodiment, a structure including a sea phase, which is a continuous phase, and an island phase, which is a disperse phase, is referred to as "sea-island structure".

Examples of the resin include a styrene resin, an acrylic resin, an epoxy resin, a polyester resin, a polyether resin, a silicone resin, and a polyvinyl butyral resin. The resins may be used alone or in combination of two or more.

The resin may be an acrylic resin in consideration of dispersion of the organopolysiloxane. The term "acrylic resin" used herein refers to a resin such that 50 mol % or more of polymerization constituents of the resin is one or more selected from acrylates and methacrylates.

Examples of the monomer constituting the acrylic resin include the following acrylates and methacrylates:

(i) at least one acrylate selected from the group consisting of pentaerythritol triacrylate, pentaerythritol tetraacrylate, ditrimethylolpropane tetraacrylate, dipentaerythritol hexaacrylate, alkyl acrylate, benzyl acrylate, phenyl acrylate, ethylene glycol diacrylate, and bisphenol A diacrylate; and (ii) at least one methacrylate selected from the group consisting of pentaerythritol trimethacrylate, pentaerythritol tetramethacrylate, ditrimethylolpropane tetramethacrylate, dipentaerythritol hexamethacrylate, alkyl methacrylate, benzyl methacrylate, phenyl methacrylate, ethylene glycol dimethacrylate, and bisphenol A dimethacrylate.

Examples of the monomer constituting the acrylic resin further include metal salt-containing acrylic monomers resistant to ultraviolet radiation. Specific examples thereof include zirconium acrylate, zirconium carboxyethyl acrylate, and zirconium bromonorbornanelactone carboxylate triacrylate.

The organopolysiloxane may be either a linear or cyclic organopolysiloxane. The organopolysiloxane may be a linear organopolysiloxane in order to further reduce the occurrence of faulty cleaning of the intermediate transfer body.

The organic group included in the organopolysiloxane is preferably a monovalent organic group having 1 to 20 carbon atoms, is more preferably a monovalent organic group having 1 to 10 carbon atoms, and is further preferably a monovalent organic group having 1 to 6 carbon atoms. Examples of the organic group included in the organopolysiloxane include alkyl groups, such as a methyl group, an ethyl group, a propyl group, and a butyl group; aryl groups, such as a phenyl group and a tolyl group; alkenyl groups, such as a vinyl group and an allyl group; and aralkyl groups, such as a β-phenylethyl group and a β-phenylpropyl group. The number of types of the organic groups included in the organopolysiloxane may be one or two or more.

The alkyl group included in the organopolysiloxane is preferably an alkyl group having 1 to 6 carbon atoms, is more preferably an alkyl group having 1 to 4 carbon atoms, and is further preferably a methyl group. The number of types of the alkyl groups included in the organopolysiloxane may be one or two or more.

The weight average molecular weight of the organopolysiloxane is preferably 10,000 or more, is more preferably 20,000 or more, and is further preferably 40,000 or more in order to reduce the bleeding out of the organopolysiloxane to the surface of the surface layer. The weight average molecular weight of the organopolysiloxane is preferably 100,000 or less, is more preferably 80,000 or less, and is further preferably 60,000 or less in order to form an island phase having an adequate diameter.

The molecular weight of the organopolysiloxane is measured by gel permeation chromatography (GPC), in which "HPLC1100" produced by Tosoh Corporation is used as measuring equipment, two columns "TSKgel GMHHR-M" (inside diameter: 7.8 mm, length: 30 cm) produced by Tosoh Corporation are arranged in series, propylene glycol monomethyl ether is used as a solvent, and monodisperse polystyrene is used as reference sample.

The organopolysiloxane may be at least one selected from the group consisting of dimethylpolysiloxane and derivatives thereof. Examples of the derivatives of dimethylpolysiloxane include dimethylpolysiloxane that includes a functional group attached to the terminal (one or both of the terminals). Specific examples of the derivatives of dimethylpolysiloxane include polyether-modified dimethylpolysiloxane, polyol-modified dimethylpolysiloxane, acrylic resin-modified dimethylpolysiloxane, fatty acid ester-modified dimethylpolysiloxane, and phenyl-modified dimethylpolysiloxane.

The weight average molecular weights of the dimethylpolysiloxane and derivatives thereof are preferably 10,000 or more, are more preferably 20,000 or more, and are further preferably 40,000 or more in order to reduce the bleeding out of the organopolysiloxane to the surface of the surface layer. The weight average molecular weights of the dimethylpolysiloxane and derivatives thereof are preferably 100,000 or less, are more preferably 80,000 or less, and are further preferably 60,000 or less in order to form an island phase having an adequate dispersion diameter.

The content of the organopolysiloxane in the surface layer is preferably 1% by mass or more and 10% by mass or less, is more preferably 2% by mass or more and 6% by mass or less, and is further preferably 3% by mass or more and 6% by mass or less of the total mass of the surface layer.

The surface layer may include a silicone surfactant. The term "silicone surfactant" used herein refers to a surfactant having a skeleton including a siloxane bond.

Examples of the silicone surfactant include an alkyl-modified silicone oil and a polyether-modified silicone oil. Examples of commercial silicone surfactants include "DISPARLON LS-009" and "DISPARLON AQ-7120" produced by Kusumoto Chemicals, Ltd.

The content of the silicone surfactant in the surface layer is preferably 0.002% by mass or more and 0.1% by mass or less, is more preferably 0.02% by mass or more and 0.08% by mass or less, and is further preferably 0.03% by mass or more and 0.05% by mass or less of the total mass of the surface layer.

In this exemplary embodiment, the content of perfluoropolyether in the surface layer of the intermediate transfer body may be relatively low in order to reduce the bleeding out of the constituent.

The content of perfluoropolyether in the surface layer is preferably 10% by mass or less, is more preferably 5% by mass or less, is further preferably 1% by mass or less, and is particularly preferably 0% by mass of the total mass of the surface layer.

The surface layer may include a conductant agent. Examples of the conductant agent include metal oxides, such as indium tin oxide, tin oxide, titanium oxide, and yttrium oxide; carbon black materials, such as Ketjenblack, oil furnace black, channel black, and acetylene black; metals, such as aluminum and nickel; ionic conductive substances, such as potassium titanate, potassium chloride, sodium perchlorate, and lithium perchlorate; and ionic conductive polymers, such as polyaniline, polyether, polypyrrole, polysulfone, and polyacetylene. The above conductant agents may be used alone or in combination of two or more.

The conductant agent included in the surface layer may be a metal oxide, such as indium tin oxide, tin oxide, titanium oxide, or yttrium oxide. In the case where the conductant agent is a metal oxide, the content of the conductant agent may be 1 part by mass or more and 10 parts by mass or less relative to 100 parts by mass of the resin.

The surface layer may include an additive, such as an antioxidant, a crosslinking agent, a flame retardant, a colorant, or a filler.

The thickness of the surface layer is preferably 1 μm or more and is more preferably 2 μm or more in consideration of the abrasion resistance of the surface layer. The thickness of the surface layer is preferably 20 μm or less and is more preferably 10 μm or less in consideration of the flex resistance of the intermediate transfer body.

The average diameter of the island phase in a cross section of the surface layer may be 0.01 μm or more and 2 μm or less. When the average diameter of the island phase is 0.01 μm or more, the occurrence of faulty cleaning of the intermediate transfer body may be further reduced. From the above viewpoint, the average diameter of the island phase is more preferably 0.1 μm or more and is further preferably 0.5 μm or more. When the average diameter of the island phase is 2 μm or less, inconsistencies in the transfer of a toner to a recording medium may be reduced. From the above viewpoint, the average diameter of the island phase is more preferably 1.5 μm or less and is further preferably 1.0 μm or less.

The area fraction of the island phase in a cross section of the surface layer may be 1% or more and 10% or less. When the area fraction of the island phase is 1% or more, the occurrence of faulty cleaning of the intermediate transfer body may be further reduced. From the above viewpoint, the area fraction of the island phase is more preferably 2% or more and is further preferably 4% or more. When the area fraction of the island phase is 10% or less, inconsistencies in the transfer of a toner to a recording medium may be reduced. From the above viewpoint, the area fraction of the island phase is more preferably 8% or less and is further preferably 6% or less.

The determination of the sea-island structure and the measurement of the dimensions and area of the island phase are conducted by the following method.

(1) Taking Image of Cross Section of Surface Layer

The surface layer is cut in the thickness direction by the cryomicrotome method to prepare a slice sample of the surface layer. An image of the slice sample is taken with a scanning electron microscope. As needed, the slice sample is stained with osmic acid in a desiccator before the image is taken with the scanning electron microscope.

(2) Distinguishing Sea Phase and Island Phase from Each Other

The sea and island phases included in the sea-island structure can be distinguished from each other by the color density. Whether the sea-island structure is present and whether the sea and island phases are present are determined on the basis of the color density.

(3) Average Diameter and Area Fraction of Island Phase

Within the image, 10 regions with sides of 4 micrometers are randomly selected. Thus, the total area of the observation regions is 160 $\mu m^2$. When the thickness of the surface layer is less than 4 μm, the number of the regions that are to be observed is increased such that the total area of the observation regions reaches 160 $\mu m^2$.

The length (μm) of the major axis of each of the island phase portions that are found in the observation regions is measured, and the arithmetic average thereof is considered as an average diameter (μm) of the island phase. The length of the major axis of an island phase portion is the length of the longest of the straight lines that connect any two points on the outline of the island phase portion to each other.

The area of each of the island phase portions that are found in the observation region is measured. The ratio of the total area of the island phase to the total area (i.e., 160 $\mu m^2$) of the surface layer is calculated and considered as the area fraction (%) of the island phase.

Other Layer

The intermediate transfer body according to this exemplary embodiment may include a layer other than the base layer or the surface layer. The intermediate transfer body may include, for example, a metal layer or a metal oxide layer interposed between the base layer and the surface layer.

Method for Producing Intermediate Transfer Body

Examples of a method for producing the intermediate transfer body according to this exemplary embodiment include a production method including a first step of preparing a pipe-like member that serves as a base layer, and a second step of forming a surface layer on the pipe-like member.

The pipe-like member prepared in the first step may be any of the following molded articles: an extrusion molded article produced by melting a resin composition including a resin and a conductant agent, extruding the molten resin composition into a belt-like shape through a die, and solidifying the belt-shaped resin composition; an injection molded article produced by melting a resin composition including a resin and a conductant agent, charging the molten resin composition into a belt-shaped mold, and solidifying the belt-shaped resin composition; and a coat molded article prepared by applying a liquid composition including a resin, a resin precursor, or monomer, and a conductant agent to a core and solidifying the resulting coating film.

Examples of the second step include a step of applying a liquid composition including a resin, a resin precursor, or monomer, and an organopolysiloxane onto the outer peripheral surface of the pipe-like member and solidifying the resulting coating film; and a step of applying a liquid composition including a resin, a resin precursor, or monomer, and an organopolysiloxane to a core, solidifying the resulting coating film to prepare a pipe-like film, and depositing the pipe-like film on the pipe-like member. In the solidification of the liquid composition, optionally, drying, heating, electron beam irradiation, or ultraviolet irradiation may be performed in accordance with the types of the constituents.

A polymerization initiator, a silicone surfactant, a conductant agent, and the like may be optionally added to the liquid composition used for forming the surface layer.

Image Forming Apparatus

An image forming apparatus according to this exemplary embodiment includes a photosensitive member; a charging unit that charges a surface of the photosensitive member; an electrostatic image formation unit that forms an electrostatic image on the charged surface of the photosensitive member; a developing unit that includes a developer including a toner and develops the electrostatic image formed on the surface of the photosensitive member with the developer to form a toner image; an intermediate transfer body; a first transfer unit that transfers the toner image onto a surface of the intermediate transfer body as first transfer; and a second transfer unit that transfers the toner image transferred on the surface of the intermediate transfer body to a recording medium as second transfer. The intermediate transfer body is the above-described intermediate transfer body according to the exemplary embodiment.

The image forming apparatus according to this exemplary embodiment may optionally include, for example, the following components: a fixing unit that fixes the toner image transferred on the surface of the recording medium; a photosensitive member cleaning unit that cleans the surface of the photosensitive member that has not been charged, subsequent to the transfer of the toner image; and an erasing unit that irradiates, with erasing light, the surface of the photosensitive member that has not been charged, subsequent to the transfer of the toner image, in order to erase charge. A portion of the image forming apparatus according to this exemplary embodiment which includes the developing unit may have a cartridge structure (i.e., process cartridge) detachably attachable to the image forming apparatus.

An example of the image forming apparatus according to this exemplary embodiment is described below. The image forming apparatus is not limited thereto. Hereinafter, only components illustrated in drawings are described; others are omitted.

Figure 2:
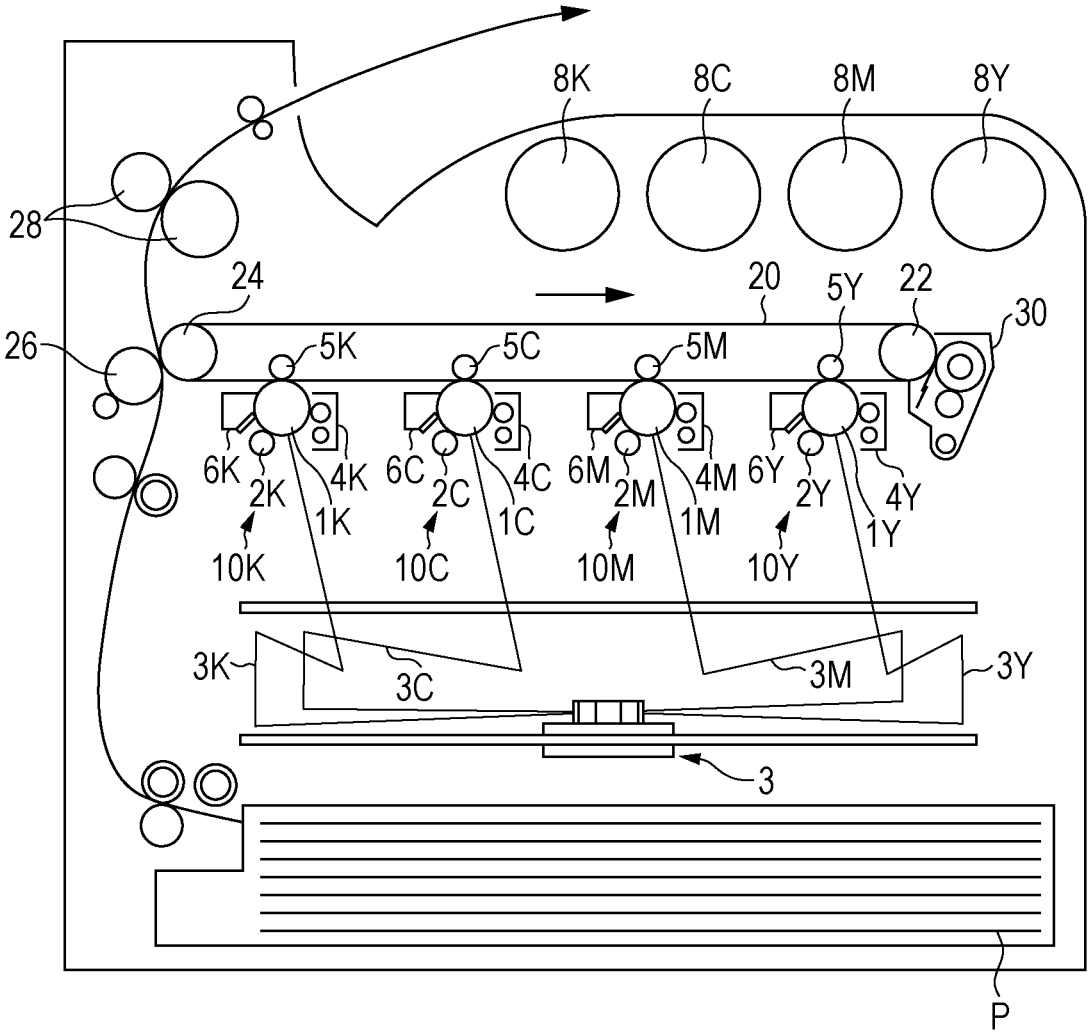
FIG. 2 is a schematic diagram illustrating an example of an image forming apparatus according to the exemplary embodiment.

FIG. 2 schematically illustrates the image forming apparatus according to this exemplary embodiment.

The image forming apparatus illustrated in FIG. 2 includes first to fourth electrophotographic image formation units 10Y, 10M, 10C, and 10K that form yellow (Y), magenta (M), cyan (C), and black (K) images, respectively, on the basis of color separation image data. The image formation units (hereinafter, referred to simply as "units") 10Y, 10M, 10C, and 10K are horizontally arranged in parallel at a predetermined distance from one another. The units 10Y, 10M, 10C, and 10K may be process cartridges detachably attachable to the image forming apparatus.

An intermediate transfer belt (example of the intermediate transfer body) 20 runs above and extends over the units 10Y, 10M, 10C, and 10K. The intermediate transfer belt 20 is wound around a drive roller 22 and a support roller 24, which are arranged to contact with the inner surface of the intermediate transfer belt 20, and runs clockwise in FIG. 2, that is, in the direction from the first unit 10Y to the fourth unit 10K. Using a spring or the like (not illustrated), a force is applied to the support roller 24 in a direction away from the drive roller 22, thereby applying tension to the intermediate transfer belt 20 wound around the drive roller 22 and the support roller 24. An intermediate transfer belt-cleaning device 30 is disposed so as to contact with the image holding surface of the intermediate transfer belt 20 and to face the drive roller 22.

Developing devices (examples of the developing units) 4Y, 4M, 4C, and 4K of the units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same structure and the same action, the following description is made with reference to, as a representative, the first unit 10Y that forms an yellow image and is located upstream in a direction in which the intermediate transfer belt runs.

The first unit 10Y includes a photosensitive member 1Y. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic image formation unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer unit) 5Y that transfers the developed toner image to the intermediate transfer belt 20; and a photosensitive member cleaning device 6Y that removes a toner remaining on the surface of the photosensitive member 1Y after the first transfer.

The first transfer roller 5Y is disposed inside of the intermediate transfer belt 20 so as to face the photosensitive member 1Y. Each of the first transfer rollers 5Y, 5M, 5C, and 5K of the respective units is connected to a bias power supply (not illustrated) that applies a first transfer bias to the first transfer rollers.

A second transfer roller (example of the second transfer unit) 26 is disposed outside of the intermediate transfer belt 20 so as to face the support roller 24 across the intermediate transfer belt 20. The second transfer roller 26 is connected to a bias power supply (not illustrated) that applies a second transfer bias to the second transfer roller 26.

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive support (e.g., volume resistivity at 20° C.: $1\times10^{-6}$ Ωcm or less). The photosensitive layer is normally of high resistance (comparable with the resistance of ordinary resins), but, upon being irradiated with the laser beam, the specific resistance of the portion irradiated with the laser beam varies. Thus, the exposure device 3 irradiates the charged surface of the photosensitive member 1Y with the laser beam 3Y on the basis of the image data of the yellow image sent from the controller (not illustrated). As a result, an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is developed and visualized in the form of a toner image by the developing device 4Y at the developing position.

The developing device 4Y includes an electrostatic image developer including, for example, at least, a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the erased latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, in the first unit 10Y, for example, +10 μA by a controller (not illustrated).

Each of the first transfer biases applied to first transfer rollers 5M, 5C, and 5K of the second, third, and fourth units 10M, 10C, and 10K is controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are stacked on top of another.

The intermediate transfer belt 20 on which toner images of four colors are multiple-transferred in the first to fourth units is then transported to a second transfer section formed by the intermediate transfer belt 20, the support roller 24, and the second transfer roller 26. A recording paper (example of the recording medium) P is fed by a feed mechanism into a narrow space between the second transfer roller 26 and the intermediate transfer belt 20 that contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not illustrated) that detects the resistance of the second transfer section and controlled by changing voltage.

The recording paper P, on which the toner image is transferred, is transported into a nip part of the fixing device (example of the fixing unit) 28 at which a pair of fixing rollers contact with each other. The toner image is fixed to the recording paper P to form a fixed image. The recording paper P, to which the color image has been fixed, is transported toward an exit portion. Thus, the series of the steps for forming a color image are terminated.

Examples of the recording paper P to which a toner image is transferred include plain paper used in electrophotographic copiers, printers, and the like. Instead of the recording paper P, OHP films and the like may be used as a recording medium.

EXAMPLES

The exemplary embodiment is described more specifically with reference to Examples below. The exemplary embodiment is not limited to Examples below. Synthesis, treatment, production, and the like are conducted at room temperature (25° C.±3° C.) unless otherwise specified.

Example 1

Preparation of Base Layer Forming Liquid Composition

To a N-methyl-2-pyrrolidone solution of polyamic acid produced from 3,3',4,4'-biphenyltetracarboxylic dianhydride and 4,4'-diaminodiphenyl ether (solid component concentration after imide conversion: 18 mass %), 22 parts by mass of carbon black particles "FW200" produced by Orion Engineered Carbons are added relative to 100 parts by mass of solid component produced after imide conversion. The resulting mixture is stirred to form a base layer forming liquid composition.

Preparation of Pipe-like Member Used as Base Layer

An aluminum cylindrical body having an outside diameter of 278 mm and a length of 600 mm is prepared. While the aluminum cylindrical body is rotated, the base layer forming liquid composition is ejected onto a central part of the aluminum cylindrical body which has a width of 500 mm through a dispenser. While the aluminum cylindrical body is kept horizontal, the resulting coating film is dried by heating at 140° C. for 30 minutes. Subsequently, the coating film is heated for 120 minutes such that the maximum temperature is 320° C. Hereby, a polyimide pipe-like member is formed on the aluminum cylindrical body.

Preparation of Surface Layer Forming Liquid Composition

With a mixed solvent including 1-propanol and 2-butanol at a mixing ratio of 1:3, 25 parts by mass of zirconium bromonorbornanelactone carboxylate triacrylate ("PRM30" produced by Aldrich), 22 parts by mass of dipentaerythritol penta-/hexa-acrylate, and 2 parts by mass of 1-hydroxyhexyl phenyl ketone are mixed at a concentration of 10% by mass. The resulting mixture is stirred. Subsequently, 3 parts by mass of polyether-modified dimethylpolysiloxane "KP-101" produced by Shin-Etsu Chemical Co., Ltd., 0.3 parts by mass of silicone surfactant "DISPARLON LS-009" produced by Kusumoto Chemicals, Ltd., and a certain amount of isopropanol dispersion liquid of indium tin oxide (produced by Aldrich) such that the amount of indium tin oxide is 5 parts by mass are added to the mixture relative to 100 parts by mass of solid content of the resulting resin after solidification. The resulting mixture is then passed through an opposing collision-type high pressure homogenizer produced by JOKOH CO., LTD. 5 times at 100 MPa. Hereby, a surface layer forming liquid composition is prepared.

Formation of Surface Layer

The surface layer forming liquid composition is applied onto the outer peripheral surface of the pipe-like member disposed on the aluminum cylindrical body by spray coating such that the resulting coating film has a thickness of 5 μm after solidification. The resulting multilayer body is heated with a rotary drying furnace at 80° C. for 2 minutes. Then, the multilayer body is charged into an ultraviolet irradiation device produced by SEN ENGINEERING CO., LTD. which includes a low-pressure mercury lamp. While the aluminum cylindrical body is rotated such that the distance between the low-pressure mercury lamp and the surface layer is set to 10 mm, the aluminum cylindrical body is irradiated with ultraviolet radiation for 15 minutes at an irradiation intensity of 17 mJ/cm$^2$.

Preparation of Endless Belt

The multilayer body including the base layer and the surface layer is removed from the aluminum cylindrical body and cut to a width of 363 mm. Hereby, an endless belt that serves as an intermediate transfer body is prepared. The intermediate transfer body has a width of 363 mm. The base layer has a thickness of 75 μm. The surface layer has a thickness of 5 μm.

Examples 2 to 4

An intermediate transfer body is prepared as in Example 1, except that the amount of polyether-modified dimethylpolysiloxane "KP-101" produced by Shin-Etsu Chemical Co., Ltd. used in the preparation of the surface layer forming liquid composition is changed.

Example 5

An intermediate transfer body is prepared as in Example 1, except that the pressure at which the treatment is performed using the opposing collision-type high pressure homogenizer is changed to 200 MPa.

Example 6

An intermediate transfer body is prepared as in Example 1, except that the pressure at which the treatment is performed using the opposing collision-type high pressure homogenizer is changed to 75 MPa.

Example 7

An intermediate transfer body is prepared as in Example 1, except that the pressure at which the treatment is performed using the opposing collision-type high pressure homogenizer is changed to 50 MPa.

Examples 8 to 12

An intermediate transfer body is prepared as in Example 1, except that the type or weight average molecular weight (Mw) of the organopolysiloxane used in the preparation of the surface layer forming liquid composition is changed as described in Table 1.

Comparative Example 1

An intermediate transfer body is prepared as in Example 1, except that the polyether-modified dimethylpolysiloxane "KP-101" produced by Shin-Etsu Chemical Co., Ltd. used in the preparation of the surface layer forming liquid composition is replaced with perfluoropolyether having a weight average molecular weight of 5,000.

Performance Evaluations

Colored Streaks

At a temperature of 28° C. and a relative humidity of 85%, an image having an area coverage of 25% is formed on 100,000 A4-size paper sheets with an electrophotographic image forming apparatus that is a modification of "700Digital Color Press" produced by Fuji Xerox Co., Ltd. and a cyan developer produced by Fuji Xerox Co., Ltd. Subsequently, an image chart including a solid image and a halftone image having a toner deposition density of 0.1 mg/cm$^2$ is formed on 500 A4-size paper sheets. Each of the 10th, 50th, 100th, and 500th sheets are visually inspected for colored streaks formed in the halftone image, and the total number of the colored streaks is classified as follows.

G1: 0

G2: 1

G3: 2 to 5, acceptable

G4: 6 or more, not acceptable in practical applications

Transfer Inconsistencies

At a temperature of 21° C. and a relative humidity of 10%, a test chart having an area coverage of 35% is sequentially formed on 20,000 A4-size embossed paper sheets "LEATHAC 66" produced by Tokushu Tokai Paper Co., Ltd. with an electrophotographic image forming apparatus that is a modification of "700Digital Color Press" produced by Fuji Xerox Co., Ltd. and a cyan developer produced by Fuji Xerox Co., Ltd. In the formation of the image, the fixing temperature is set to 190° C. and the fixing pressure is set to 4.0 kg/cm$^2$. The image part of the 20,000th sheet is inspected using a scale loupe with a magnification of 100 times and classified as follows.

G1: Transfer inconsistencies are not present in the image.

G2: Slight transfer inconsistencies are present in the image, but negligible in practical applications.

G3: Transfer inconsistencies are present in the image, but acceptable.

G4: Transfer inconsistencies are present in the image, and not acceptable.

TABLE 1

| | Surface Layer | | | | | |
|---|---|---|---|---|---|---|
| | Organopolysiloxane, or comparative constituent | | Island phase | | Performance evaluations | |
| | Type — | Mw — | Average diameter μm | Area fraction % | Colored streaks — | Transfer inconsistencies — |
| Example 1 | Polyether-modified dimethylpolysiloxane | 45,000 | 0.20 | 5 | G1 | G1 |
| Example 2 | Polyether-modified dimethylpolysiloxane | 45,000 | 0.20 | 1 | G1 | G3 |
| Example 3 | Polyether-modified dimethylpolysiloxane | 45,000 | 0.20 | 3 | G1 | G2 |
| Example 4 | Polyether-modified dimethylpolysiloxane | 45,000 | 0.20 | 10 | G2 | G1 |
| Example 5 | Polyether-modified dimethylpolysiloxane | 45,000 | 0.01 | 5 | G1 | G1 |
| Example 6 | Polyether-modified dimethylpolysiloxane | 45,000 | 1.00 | 5 | G2 | G1 |
| Example 7 | Polyether-modified dimethylpolysiloxane | 45,000 | 2.00 | 5 | G3 | G2 |
| Example 8 | Polyether-modified dimethylpolysiloxane | 20,000 | 0.20 | 5 | G1 | G1 |
| Example 9 | Polyether-modified dimethylpolysiloxane | 10,000 | 0.20 | 5 | G1 | G1 |
| Example 10 | Acrylic resin-modified dimethylpolysiloxane | 42,000 | 0.20 | 5 | G1 | G1 |
| Example 11 | Fatty acid-modified dimethylpolysiloxane | 40,000 | 0.20 | 5 | G1 | G1 |
| Example 12 | Polyol-modified dimethylpolysiloxane | 20,000 | 0.20 | 5 | G1 | G1 |
| Comparative Example 1 | Perfluoropolyether | 10,000 | 0.10 | 10 | G4 | G2 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An intermediate transfer body comprising:

a base layer; and a surface layer disposed on the base layer, wherein the surface layer includes a sea-island structure, the sea-island structure including a sea phase and an island phase, the sea phase including a resin, the island phase including an organopolysiloxane, and a content of the organopolysiloxane in the surface layer is 1% by mass or more and 10% by mass or less.

2. The intermediate transfer body according to claim 1, wherein the organopolysiloxane includes at least one selected from the group consisting of dimethylpolysiloxane and derivatives thereof.

3. The intermediate transfer body according to claim 1, wherein the organopolysiloxane included in the island phase has a weight average molecular weight of 10,000 or more and 100,000 or less.

4. The intermediate transfer body according to claim 2, wherein the organopolysiloxane included in the island phase has a weight average molecular weight of 10,000 or more and 100,000 or less.

5. The intermediate transfer body according to claim 1, wherein the resin included in the sea phase includes an acrylic resin.

6. The intermediate transfer body according to claim 2, wherein the resin included in the sea phase includes an acrylic resin.

7. The intermediate transfer body according to claim 3, wherein the resin included in the sea phase includes an acrylic resin.

8. The intermediate transfer body according to claim 1, wherein the surface layer includes a silicone surfactant.

9. The intermediate transfer body according to claim 2, wherein the surface layer includes a silicone surfactant.

10. The intermediate transfer body according to claim 3, wherein the surface layer includes a silicone surfactant.

11. The intermediate transfer body according to claim 4, wherein the surface layer includes a silicone surfactant.

12. The intermediate transfer body according to claim 5, wherein the surface layer includes a silicone surfactant.

13. The intermediate transfer body according to claim 6, wherein the surface layer includes a silicone surfactant.

14. The intermediate transfer body according to claim 7, wherein the surface layer includes a silicone surfactant.

15. The intermediate transfer body according to claim 1, wherein an average diameter of the island phase in a cross section of the surface layer is 0.01 μm or more and 2 μm or less.

16. The intermediate transfer body according to claim 2, wherein an average diameter of the island phase in a cross section of the surface layer is 0.01 μm or more and 2 μm or less.

17. The intermediate transfer body according to claim 3, wherein an average diameter of the island phase in a cross section of the surface layer is 0.01 μm or more and 2 μm or less.

18. The intermediate transfer body according to claim 1, wherein an average diameter of the island phase in a cross section of the surface layer is 0.1 μm or more and 1 μm or less.

19. The intermediate transfer body according to claim 1, wherein an area fraction of the island phase in a cross section of the surface layer is 1% or more and 10% or less.

20. An image forming apparatus comprising:

a photosensitive member;

a charging unit that charges a surface of the photosensitive member;

an electrostatic image formation unit that forms an electrostatic image on the charged surface of the photosensitive member;

a developing unit that includes a developer including a toner and develops the electrostatic image formed on the surface of the photosensitive member with the developer to form a toner image;

the intermediate transfer body according to claim 1;

a first transfer unit that transfers the toner image onto a surface of the intermediate transfer body as first transfer; and a second transfer unit that transfers the toner image transferred on the surface of the intermediate transfer body to a recording medium as second transfer.

* * * * *